US006279501B1

(12) United States Patent
Taylor, Jr.

(10) Patent No.: US 6,279,501 B1
(45) Date of Patent: Aug. 28, 2001

(54) UMBILICAL CONSTRAINT MECHANISM

(75) Inventor: Leland Harris Taylor, Jr., Houston, TX (US)

(73) Assignee: Mentor Subsea Technology Services, Inc., New Orleans, LA (US)

( * ) Notice: Subject to any disclaimer, the term of this patent is extended or adjusted under 35 U.S.C. 154(b) by 0 days.

(21) Appl. No.: 09/672,888

(22) Filed: Sep. 28, 2000

(51) Int. Cl.[7] ..... B63G 8/00
(52) U.S. Cl. ..... 114/312; 114/322
(58) Field of Search ..... 242/397.1, 397.2, 242/157.1; 114/312, 322, 325, 328, 44, 253, 254

(56) References Cited

U.S. PATENT DOCUMENTS 1,188,308 * 6/1916 Nyquist ..... 114/328
1,649,184 * 11/1927 Posey ..... 242/157.1
4,010,619 * 3/1977 Hightower et al. ..... 114/322
4,257,488 * 3/1981 Schnell ..... 173/133
4,778,121 * 10/1988 Minnee ..... 242/157.1
5,042,415 * 8/1991 Hoffman ..... 114/322

* cited by examiner

*Primary Examiner*—Stephen Avila
(74) *Attorney, Agent, or Firm*—D. Neil LaHaye

(57) ABSTRACT

An umbilical constraint mechanism. The mechanism keeps the umbilical line near the center of the payload bay opening when the umbilical line is deployed. The mechanism will transfer lateral umbilical loads into the drone vessel frame near the bottom of the payload bay. A modified cone shaped structure is provided in the payload bay above the normal storage position of the ROV. The cone is mounted on a frame that is capable of sliding up or down in the drone vessel.

2 Claims, 5 Drawing Sheets

UMBILICAL CONSTRAINT MECHANISM

BACKGROUND OF THE INVENTION

1. Field of the Invention

The invention is generally related to the use of a remotely operated vehicle (ROV) from a drone vessel for underwater work and more particularly to means used to restrain the umbilical line between the drone vessel and ROV.

2. General Background

Many underwater operations, such as drilling for and production of oil and gas, installation and maintenance of offshore structures, or laying and maintaining underwater pipelines require the use of a remotely operated vehicle (ROV) or robotic tooling.

The deployment of an ROV is typically achieved by launching the unit from either a bottom founded or floating host platform, a dynamically positioned marine vessel dedicated specifically for the purpose of supporting an ROV, e.g. an ROV support vessel (RSV), or any such surface vessel with sufficient size and characteristics that provide a suitably stable platform for the launching and recovery of an ROV.

Both bottom founded and floating host platforms are fixed in position at the site and are normally engaged in collateral activities such as drilling and offshore production or construction. Thus, the operations of the ROV are limited according to the distance that the ROV can travel from the host platform as well as by restrictions in operating periods due to the collateral activities of the host platform.

In the case of dedicated vessel deployment such as an RSV, significant costs are associated with operation of a fully founded marine vessel and its mobilization to and from the ROV work site. Typically, a dedicated RSV may have a crew of twenty and a considerable cost not directly related to the operation of the ROV.

ROV operation and monitoring is controlled from the host platform or RSV by means of an umbilical line between the host platform or RSV and the ROV. It can be seen from this that the operational distance of the ROV is directly related to the length of the umbilical line.

A remotely operated near surface drone vessel with adequate stability that is capable of launching, controlling, and recovering an ROV eliminates the limitations associated with operation from a fixed host platform and reduces the expense associated with a manned, dedicated RSV.

The remotely operated drone vessel requires an umbilical line, storage drum and winch to launch, control, and recover the ROV. The stability of the drone vessel can be adversely affected by deployment of the ROV. This can occur from lateral loads imposed on the drone vessel from the umbilical line and ROV that effectively decreases the stability of the drone vessel. This leaves a need for a means of reducing the effects of lateral loads applied by the umbilical line and increasing the stability of the drone vessel.

SUMMARY OF THE INVENTION

The invention addresses the above needs. What is provided is an umbilical constraint mechanism. The mechanism keeps the umbilical line near the center of the payload bay opening when the umbilical line is deployed. The mechanism will transfer lateral umbilical loads into the drone vessel frame near the bottom of the payload bay. A modified cone shaped structure is provided in the payload bay above the normal storage position of the ROV. The cone is mounted on a frame that is capable of sliding up or down in the drone vessel.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
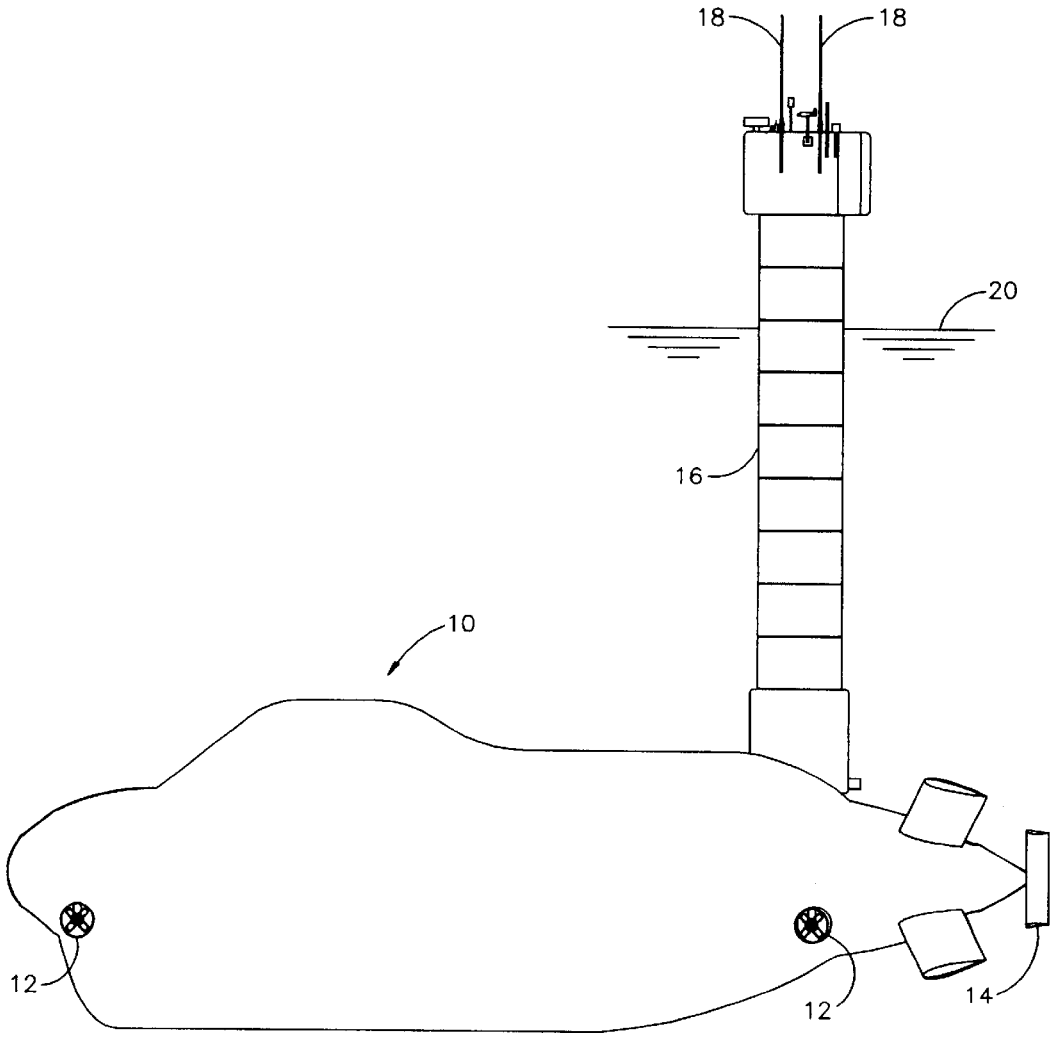
FIG. 1 illustrates a drone vessel for an ROV.

Referring to the drawings, it is seen in FIG. 1 that a drone vessel is generally indicated by the numeral 10. Drone vessel 10 is a buoyant vessel that utilizes a plurality of dynamic positioning thrusters 12, one illustrated at each corner. Drone vessel 10 is also provided with propulsion means 14. A mast 16 attached to the top of the drone vessel 10 extends upward and includes one or more radio telemetry antennas 18. As seen in FIG. 1, the operational position of the drone vessel 10 is below the water line 20, with the top of the mast 16 and the antennas being above the water line 20. This allows a support vessel or fixed structure, not shown, on the water surface to remotely control the drone vessel 10 and a remotely operated vehicle (ROV), seen in FIG. 2, that is carried by, and controlled through, the drone vessel. The power supply, motors, and electronic equipment are housed within the drone vessel 10.

Figure 2:
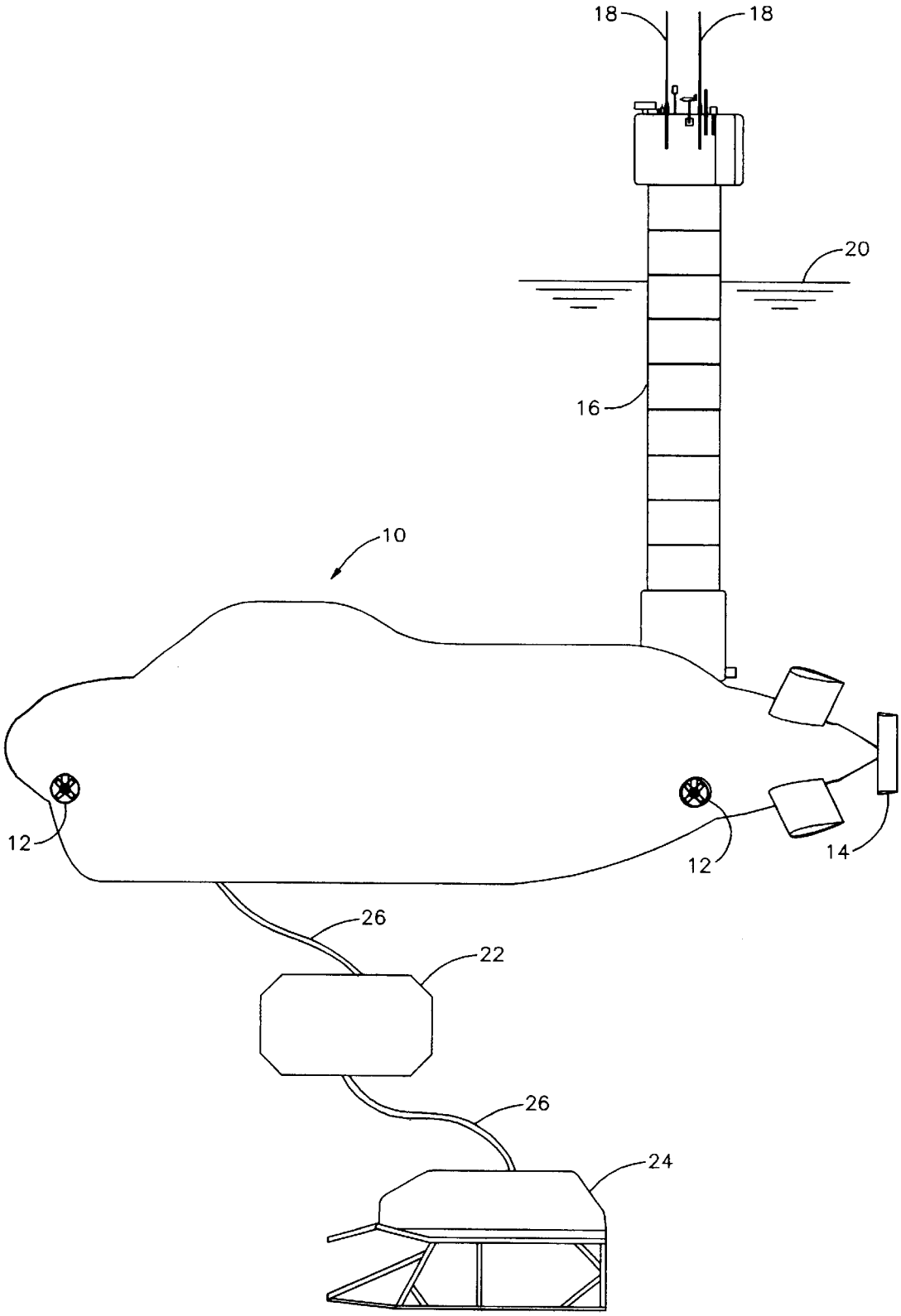
FIG. 2 illustrates a drone vessel for an ROV wherein a tether management system and ROV have been deployed from the drone vessel.

FIG. 2 illustrates a tether management apparatus 22 and ROV 24 deployed from the drone vessel 10. An umbilical line 26 stored on a drum in the drone vessel 10 provides communication with, and control of, the tether management apparatus 22 and the ROV 24. The umbilical line 26 is returned to the storage drum by a winch located in the drone vessel 10.

Figure 3:
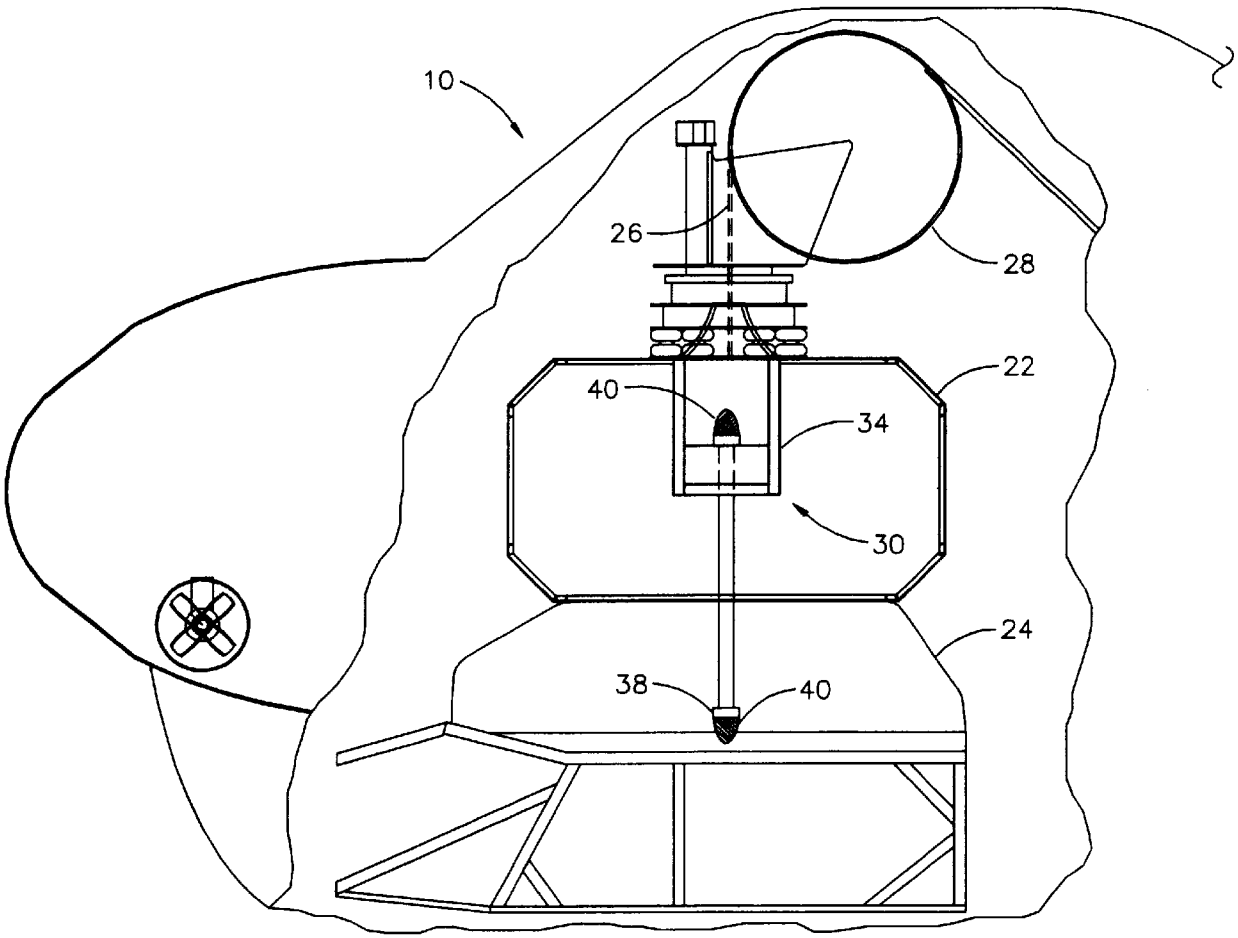
FIG. 3 is an enlarged cutaway view that illustrates the invention in the drone vessel.

FIG. 3 is an enlarged cutaway view of a portion of the drone vessel 10 and illustrates the tether management apparatus 22 and ROV 24 stored in the drone vessel 10. The umbilical line 26 is routed from a storage drum not seen over a pulley or sheave 28 and through a constraint mechanism 30, best seen in FIGS. 4 and 5, to the tether management apparatus 22 and ROV 24.

The constraint mechanism 30 is generally comprised of a pair of guide rails 32, a bar 34 slidably mounted on the guide rails 32, and a cone 36 mounted on the bar 34.

The guide rails 32 are mounted on opposite sides of the hull of the drone vessel 10 in a vertical orientation. Each guide rail 32 is provided with upper and lower stops 38 that have a greater diameter than the rails 32 and are also used as attachment points to the hull of the drone vessel 10, as indicated by numeral 40.

The bar 34 is slidably mounted on the guide rails 32 by means of a bore provided on each end of the bar 34. The bar 34 is movable between a first upper position when the tether management apparatus 22 and ROV 24 are stored in the drone vessel 10 and a second lower position when the tether management apparatus 22 and ROV 24 are deployed from the drone vessel 10 for work purposes.

A cone 36 is mounted substantially at the center of the bar 34. The cone 36 is open at each end and mounted such that the larger opening of the cone is lower than the smaller opening. The cone 36 is sized to receive the umbilical line 26 and is preferably provided with a thirty degree radius.

Figure 4:
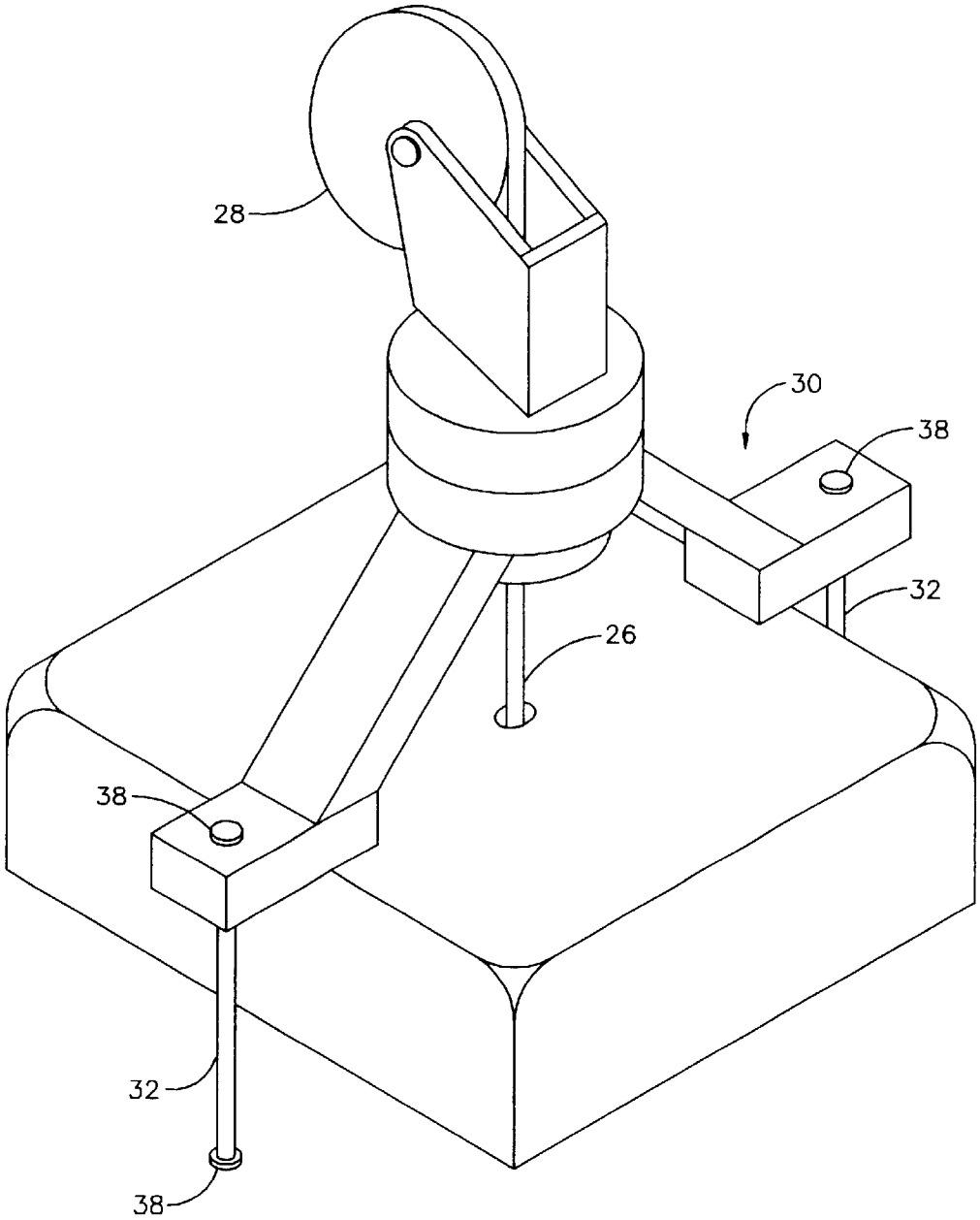
FIG. 4 is a detail perspective view of the invention in the upper storage position.
Figure 5:
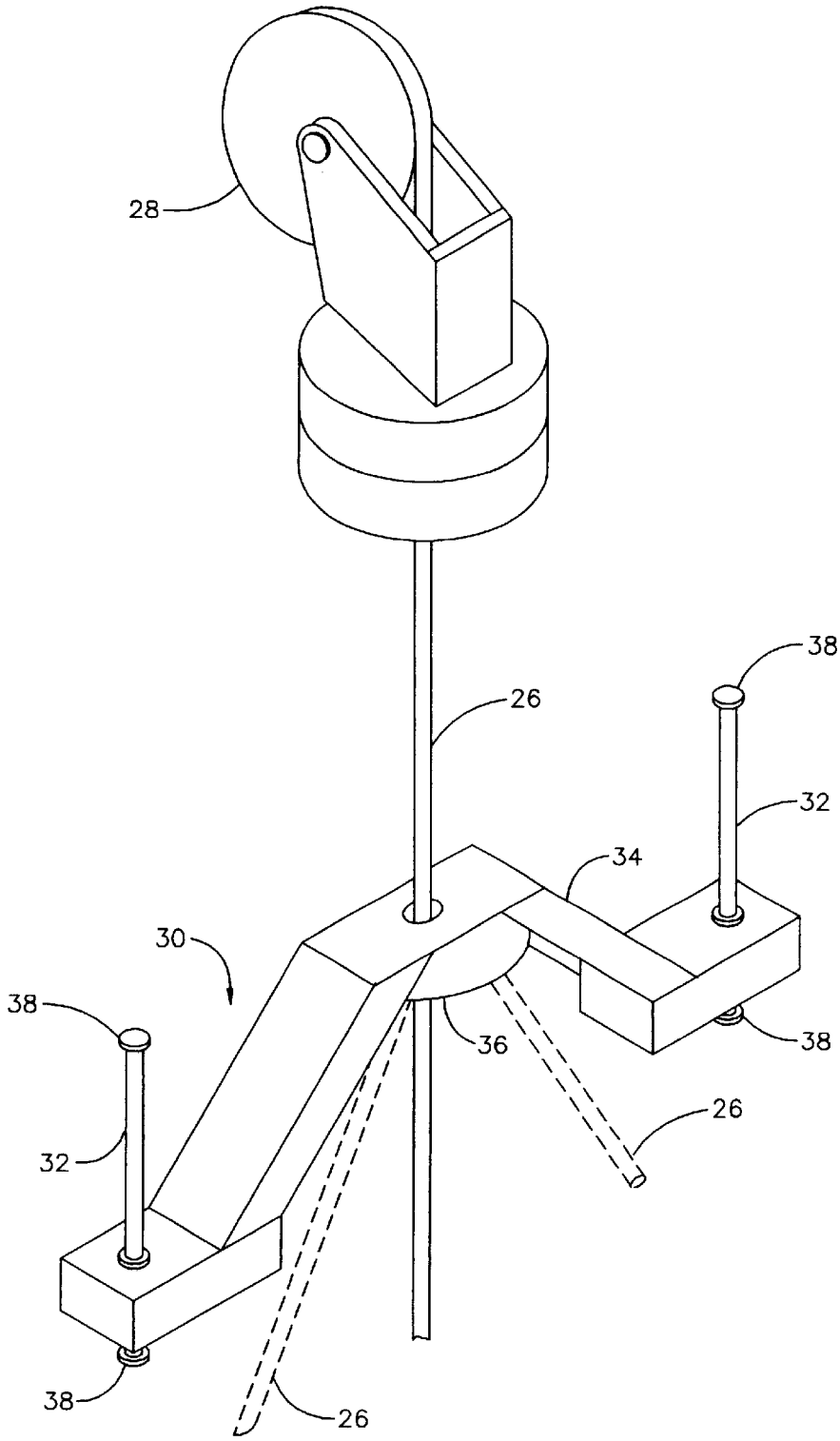
FIG. 5 is a detail perspective view of the invention in the lower operating position.

In operation, the bar 34 and cone 36 of the constraint mechanism 30 are maintained in the first upper position by the tether management apparatus 22 and ROV 24 when they are stored in the drone vessel 10 as seen in FIG. 3 and 4. The constraint mechanism 30 moves to the second lower position, as seen in FIG. 5, by the force of gravity when the tether management apparatus 22 and ROV 24 are deployed as seen in FIG. 2. When in the second lower position, the cone 36 limits the side-to-side movement of the umbilical line 26 caused by movement of the tether management apparatus 22 and ROV 24. The second lower position of the cone 36 serves to reduce the leverage of the umbilical line 26 on the drone vessel 10, compared to the upper position, by keeping the umbilical line near the center of the payload bay opening when the umbilical line is deployed. This transfers lateral umbilical line loads into the drone vessel frame near the bottom of the payload bay and thus increases the stability of the drone vessel 10. For the purposes of this invention, the tether management apparatus 22 is an addition to the ROV and so should be considered as part of the ROV with regard to the operation of the constraint mechanism 30. Thus, the ROV 24 is also capable of performing the function of moving and retaining the constraint mechanism 30 in the first upper position.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a drone vessel for an ROV having an umbilical line connected to an ROV that is stored in the drone vessel and deployed from the drone vessel, means for constraining the movement of the umbilical line caused by the ROV during deployment from the drone vessel, said constraining means comprising:

a. a guide rail mounted in the drone vessel;

b. a bar slidably mounted on the guide rail so as to be movable between a first upper position and a second lower position; and c. a cone, open at both ends, mounted on the bar and sized to receive the umbilical line.

2. The constraint mechanism of claim 1, wherein said cone has a is radius of thirty degrees.

* * * * *

UNITED STATES PATENT AND TRADEMARK OFFICE

CERTIFICATE OF CORRECTION

PATENT NO. : 6,279,501 B1
DATED : August 28, 2001
INVENTOR(S) : Leland Harris Taylor, Jr.

It is certified that error appears in the above-identified patent and that said Letters Patent is hereby corrected as shown below:

Claim 2,
Line 2, delete "is".

Signed and Sealed this

Twenty-sixth Day of February, 2002

*Attest:*

*Attesting Officer*

JAMES E. ROGAN
*Director of the United States Patent and Trademark Office*